US011542955B2

(12) United States Patent
Haaf et al.

(10) Patent No.: US 11,542,955 B2
(45) Date of Patent: Jan. 3, 2023

(54) DIAGONAL FAN HAVING AN OPTIMIZED DIAGONAL IMPELLER

(71) Applicant: ebm-papst Mulfingen GmbH & Co. KG, Mulfingen (DE)

(72) Inventors: Oliver Haaf, Kupferzell (DE); Daniel Gebert, Öhringen (DE); Johannes Dörr, Mulfingen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/274,767

(22) PCT Filed: Nov. 4, 2019

(86) PCT No.: PCT/EP2019/080093
§ 371 (c)(1),
(2) Date: Mar. 9, 2021

(87) PCT Pub. No.: WO2020/099167
PCT Pub. Date: May 22, 2020

(65) Prior Publication Data

US 2022/0049715 A1 Feb. 17, 2022

(30) Foreign Application Priority Data

Nov. 16, 2018 (DE) ..... 102018128821.2

(51) Int. Cl.
*F04D 29/32* (2006.01)
*F04D 29/38* (2006.01)
(Continued)

(52) U.S. Cl.
CPC ..... *F04D 29/386* (2013.01); *F04D 19/002* (2013.01); *F04D 25/06* (2013.01); *F04D 29/329* (2013.01); *F04D 29/541* (2013.01)

(58) Field of Classification Search
CPC .... F04D 19/002; F04D 29/329; F04D 29/541; F04D 29/4253; F04D 29/183
See application file for complete search history.

(56) References Cited

U.S. PATENT DOCUMENTS 5,695,318 A * 12/1997 Harmsen ..... F04D 17/06 415/218.1

FOREIGN PATENT DOCUMENTS

CN 209781249 U 12/2019
DE 20319741 U1 10/2004
(Continued)

OTHER PUBLICATIONS

International Search Report dated Jan. 13, 2020.
German Search Report dated Oct. 25, 2019.
Chinese Office Action dated Jun. 1, 2022.

*Primary Examiner* — Sabbir Hasan
(74) *Attorney, Agent, or Firm* — Dickinson Wright PLLC

(57) ABSTRACT

A diagonal fan having an electric motor and a diagonal impeller which can be driven about an axis of rotation (RA) by means of the electric motor. The diagonal impeller determines an air inlet and an air outlet and has a hub and impeller vanes which are distributed in the circumferential direction, extend radially outwards from the hub and are surrounded radially externally by a slinger ring. A flow angle αD formed by the slinger ring relative to the axis of rotation (RA) increases from the air inlet to the air outlet, and a flow angle αN formed by the hub relative to the axis of rotation (RA) decreases from the air inlet to the air outlet.

19 Claims, 5 Drawing Sheets

(51) Int. Cl.

| | |
|---|---|
| ***F04D 19/00*** | (2006.01) |
| ***F04D 25/06*** | (2006.01) |
| ***F04D 29/54*** | (2006.01) |

(56) References Cited

FOREIGN PATENT DOCUMENTS

| | | | | | |
|---|---|---|---|---|---|
| DE | 20319749 | U1 | 12/2004 | | |
| DE | 202010013785 | | 3/2011 | | |
| DE | 202010013785 | U1 * | 3/2011 | ..... | F04D 17/06 |
| DE | 202010013785 | U1 | 3/2011 | | |
| DE | 102014212561 | A1 | 2/2015 | | |
| DE | 202015100654 | U1 | 4/2015 | | |
| DE | 202015100654 | U1 | 5/2015 | | |
| JP | 200513598 | A | 6/2005 | | |
| JP | 2005163598 | A | 6/2005 | | |
| WO | 2011038884 | A1 | 4/2011 | | |
| WO | WO-2011038884 | A1 * | 4/2011 | ..... | F04D 17/06 |

* cited by examiner

DIAGONAL FAN HAVING AN OPTIMIZED DIAGONAL IMPELLER

RELATED APPLICATIONS

This application claims priority to and is a 35 U.S.C. § 371 national phase application of PCT/EP2019/080093, filed Nov. 4, 2019 and claims priority to German Patent Application No. 10 2018 128 821.2, filed Nov. 16, 2018, the entire contents of which are incorporated herein by reference in their entirety.

FIELD

The disclosure relates to a diagonal fan having an optimized diagonal impeller for increasing efficiency.

BACKGROUND

Diagonal fans and their use are generally known from prior art, for example, from DE 10 2014 210 373 A1.

Diagonal fans are used in applications with a high demand of air output at higher counterpressure and small installation space, for example in cooling equipment and extractor hoods. Since the axially centrally disposed motor of diagonal fans has a large motor diameter compared to the installation space and due to the radial extension of the hub, the outlet area at the outlet opening is relatively small, which results in great outlet losses of the flow due to high dynamic pressure at the outlet of the diagonal fan.

BRIEF SUMMARY

The disclosure solves the problem of providing a diagonal fan having an axial outlet flow comprising higher pressure generation and efficiency compared to axial fans of the same dimensions.

This problem is solved by the combination of features according to claim 1.

According to the disclosure, a diagonal fan comprising an electric motor and a diagonal impeller which can be driven about an axis of rotation by means of the electric motor is proposed, wherein the diagonal impeller determines an air inlet and an air outlet and has a hub and impeller vanes which are distributed in the circumferential direction, extend radially outwards from the hub, and are surrounded radially externally by a slinger ring. A flow angle formed by the slinger ring relative to the axis of rotation increases from the air inlet to the air outlet, and a flow angle formed by the hub relative to the axis of rotation decreases from the air inlet to the air outlet.

The region of the impeller vanes represents the part of the diagonal impeller through which a flow can pass. The quality of the flow along the radially external and radially internal wall sections formed by the slinger ring and the hub is an essential aspect of pressure generation, throw distance, and efficiency of the diagonal fan. The geometry at the centrifugal wheel and the hub is adjusted according to the disclosure by increasing the flow angle at the slinger ring and decreasing the flow angle at the hub in order to obtain improved values in this respect. The axis of rotation is used as the reference point, wherein the flow angle increases in the direction of the axis of rotation, starting from the value 0° (0° corresponds to an axial plane parallel to the axis of rotation).

In a further development, advantageous angular ranges for the flow angles are specifically provided at the radially outer region of the diagonal impeller, wherein the flow angle $\alpha D1$ formed at the air inlet by the slinger ring relative to the axis of rotation is defined in an angular range from $0° \leq \alpha D1 \leq 12°$ and the flow angle $\alpha D2$ formed at the air outlet by the slinger ring relative to the axis of rotation is defined in an angular range from $10° \leq \alpha D2 \leq 30°$, preferably $15° \leq \alpha D2 \leq 20°$.

Furthermore, that angular range is disclosed as a favorable variant regardless of the absolute values that the difference of the flow angles $\alpha D2 - \alpha D1$ is defined in a range of values that satisfies the condition $2° \leq \alpha D2 - \alpha D1 \leq 20°$.

As for the radially internal region on the hub, it is advantageous for the diagonal fan if the flow angle $\alpha N$ formed at the air inlet by the hub relative to the axis of rotation from the air inlet to the air outlet is defined in an angular range of $20° \leq \alpha DN1 \leq 55°$ and the flow angle $\alpha N2$ formed at the air outlet by the hub relative to the axis of rotation is defined in an angular range of $0° \leq \alpha DN2 \leq 15°$.

Furthermore, an embodiment of the diagonal fan is favorable in which the flow angles $\alpha D$ and $\alpha N$ change in a continuous course of the slinger ring and the hub, that is, the courses of the slinger ring and the hub are continuous when viewed in a radial section.

In an advantageous further development of the diagonal fan, the mean stagger angle of the impeller vanes decreases over their respective axial extension in a radial outer section of the respective impeller vane adjacent to the slinger ring by an angular range of 5° to 15°. The direction of the angle reduction is outward. The stagger angle of the impeller vanes is known in the art and determines the angle of incidence of the impeller vanes relative to an axial plane perpendicular to the axis of rotation.

The radial outer section is preferably in a range from 75% to 100% of the radial extension of the respective impeller vane, wherein 0% of the radial extension is defined at the hub and 100% of the radial extension is defined at the slinger ring.

The impeller vanes have a front vane edge facing the air inlet and a rear vane edge facing the air outlet. It is advantageous in terms of flow if at least the rear vane edge has an S shape in an axial top view. In a favorable further development, the turning point of curves in the S-shaped extension, that is, the point at which the curve direction changes, is in a range between 50% to 90%, particularly 70% to 90%, of the radial extension of the respective impeller vane. Once again, 0% of the radial extension are defined at the hub and 100% of the radial extension are defined at the slinger ring.

It is further beneficial if the front vane edges of the impeller vanes facing the air outlet are curved along their entire radial extension.

As for the geometry of the diagonal impeller of the diagonal fan, efficiency is also positively affected if the diagonal impeller has a maximum impeller diameter Da and an intake diameter Ds at the air inlet, wherein a ratio of the intake diameter Ds to the impeller diameter Da is defined as $0.8 \leq Ds/Da \leq 0.95$, preferably $0.9 \leq Ds/Da \leq 0.94$.

In another fluidically favorable embodiment of the diagonal fan, the impeller vanes have a mean axial vane extension La, which is proportional to a maximum impeller diameter Da of the diagonal impeller, such that $0.05 \leq La/Da \leq 0.25$, preferably $0.09 \leq La/Da \leq 0.18$.

In a further developed diagonal fan, the electric motor forms the flow contour of the hub in the axially central region. To this end, the hub has an axially central recess through which the electric motor extends in the axial direction, thus forming an inflow surface facing the air inlet. Axially central always defines the arrangement of the axis of rotation.

In an embodiment, the diagonal fan is further characterized in that the hub forms a motor receptacle and multiple openings are provided at the motor receptacle on a side facing the air outlet, which provides an axial flow connection from the side of the air outlet to the side of the air inlet. Thus, a portion of the air suctioned in by the diagonal impeller on the air inlet and blown out at the air outlet can flow back via the openings on the hub and improve application of the flow to the hub. The back flow is in addition used as a cooling flow along the electric motor.

For further improvement of the axial outlet flow, the diagonal fan in one embodiment includes an outlet guide vane device downstream of the diagonal impeller in the axial flow direction, which outlet guide vane device evens out an air flow generated by the diagonal impeller. The diffuse can to this end comprise a plurality of guide vanes distributed in the circumferential direction, for example. The outlet guide vane device has a protective grate which extends across an outlet section of the diagonal fan.

BRIEF DESCRIPTION OF THE DRAWINGS

Other advantageous further developments of the disclosure are characterized in the dependent claims or are explained in more detail below with reference to the figures and together with a preferred embodiment of the disclosure. Wherein:

DETAILED DESCRIPTION

Figure 1:
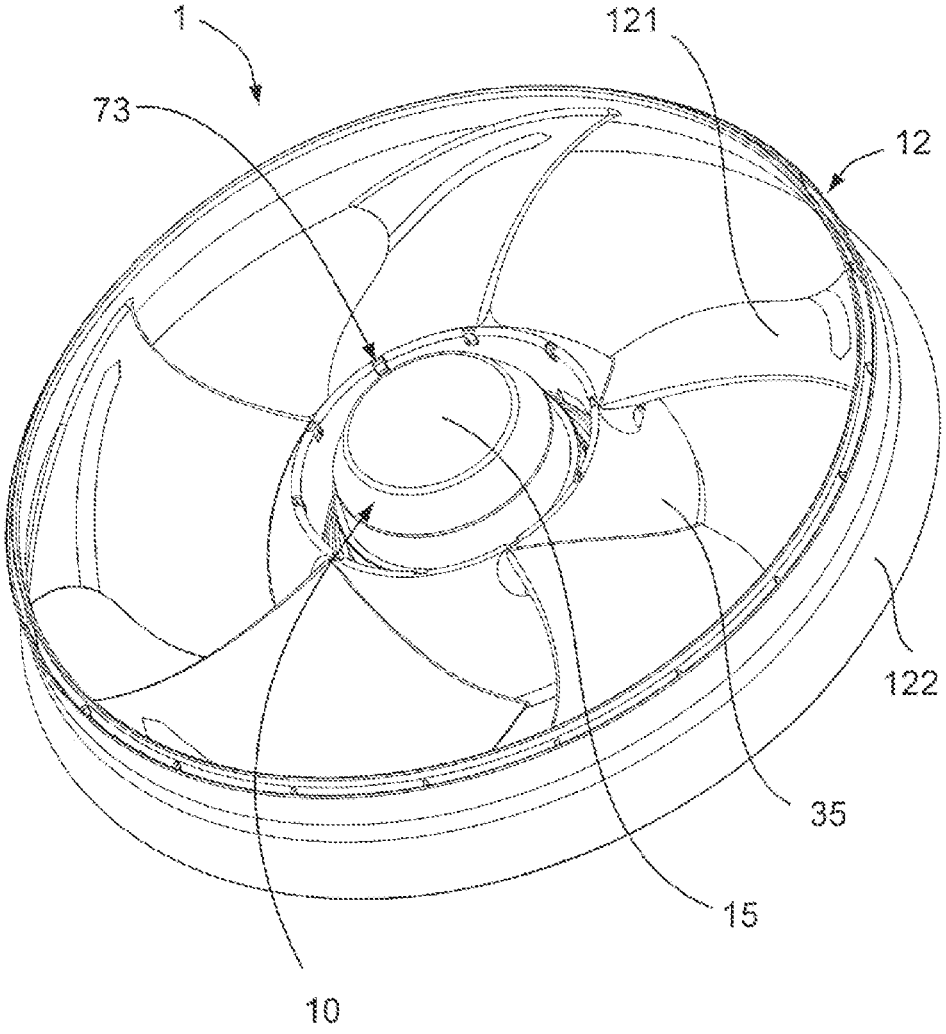
FIG. 1 shows a perspective view of an exemplary embodiment of a diagonal fan according to the disclosure.
Figure 2:
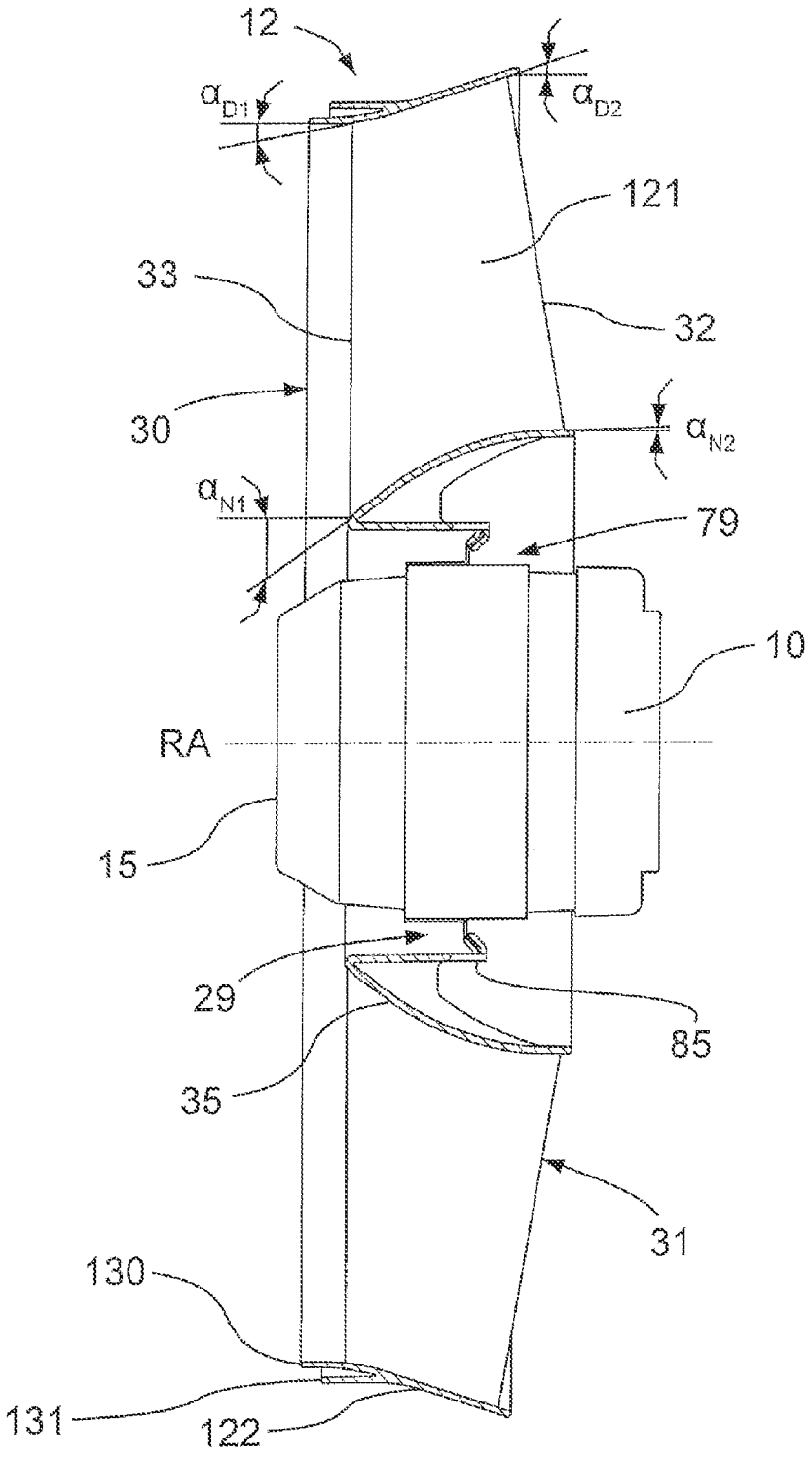
FIG. 2 shows a radial sectional view of the diagonal fan of FIG. 1.

FIGS. 1 to 5 show various views of an exemplary embodiment of the diagonal fan 1. In the embodiment shown, the diagonal fan 1 includes the electric motor 10 configured as an external rotor motor and the diagonal impeller 12 with its impeller vanes 121 distributed in the circumferential direction and extending radially outwards from the hub 35 disposed about the axis of rotation RA, which vanes are surrounded radially externally by the slinger ring 122.

The diagonal impeller 12 comprises the flow duct between the hub 35 and the inner wall of the slinger ring 122, through which duct the diagonal impeller 12 delivers air from the air inlet 30 to the air outlet 31. The radially internal wall of the flow duct is defined by the shell surface of the hub 35, the radially external wall is defined by the inner wall of the slinger ring 122. The flow angle $\alpha D1$ formed at the air inlet 30 by the slinger ring 122 relative to the axis of rotation RA is determined to be 10° in the embodiment shown, the flow angle $\alpha D2$ formed at the air outlet by the slinger ring 122 relative to the axis of rotation RA is determined to be 18°, such that the angle frequency is 8°. The flow angle $\alpha N1$ formed by the shell surface of the hub 35 relative to the axis of rotation RA at the air inlet 30 is 40°, the flow angle formed by the shell surface of the hub 35 relative to the axis of rotation RA at the air outlet 31 is 2°, such that the angle difference is 38°. Both the slinger ring 122 and the shell surface of the hub 35 are continuous in the region which forms the flow duct.

The hub 35 comprises an axially central recess 79 with a motor receptacle 29. The electric motor 10 extends in the axial direction through the recess 79 and forms the inflow surface 15 on the intake side. A plurality of openings 85 distributed in the circumferential direction are provided on the hub 35 in the region of the motor receptacle 29, through which openings a portion of the flow is conducted back along the electric motor 10 and subsequently delivered through the flow duct again. Referring now to FIG. 1, multiple openings 73 distributed in the circumferential direction are in addition provided in the axially foremost edge of the shell surface of the hub 35, which openings are flow-connected to the region of the air outlet 31.

Furthermore, the slinger ring 122 of the diagonal fan 1 forms two coaxial ring lips 130, 131 at the air inlet 30, which converge into a type of cover plate on the outlet side.

Figure 3:
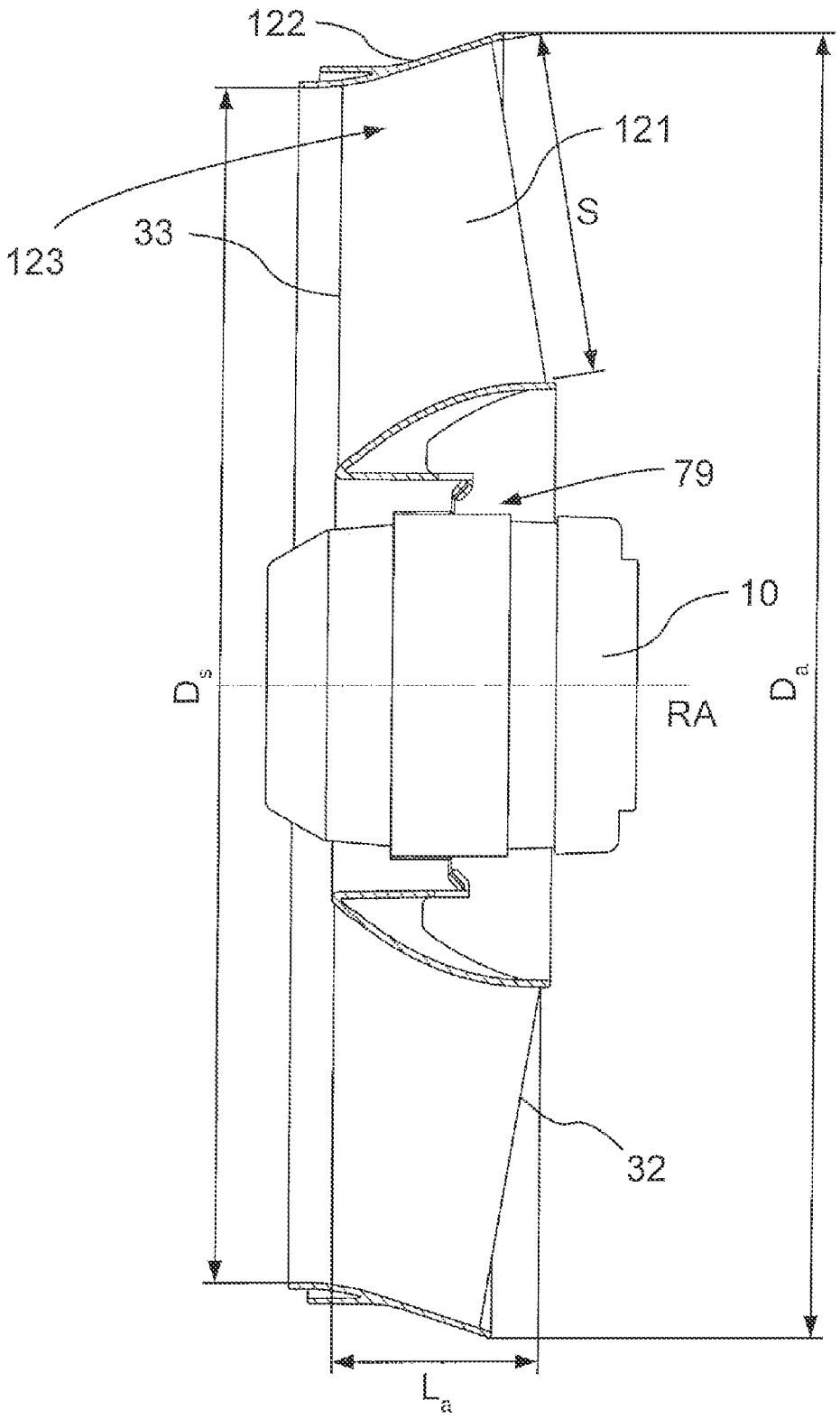
FIG. 3 shows a radial sectional view of the diagonal fan of FIG. 2 with additional explanations.
Figure 4:
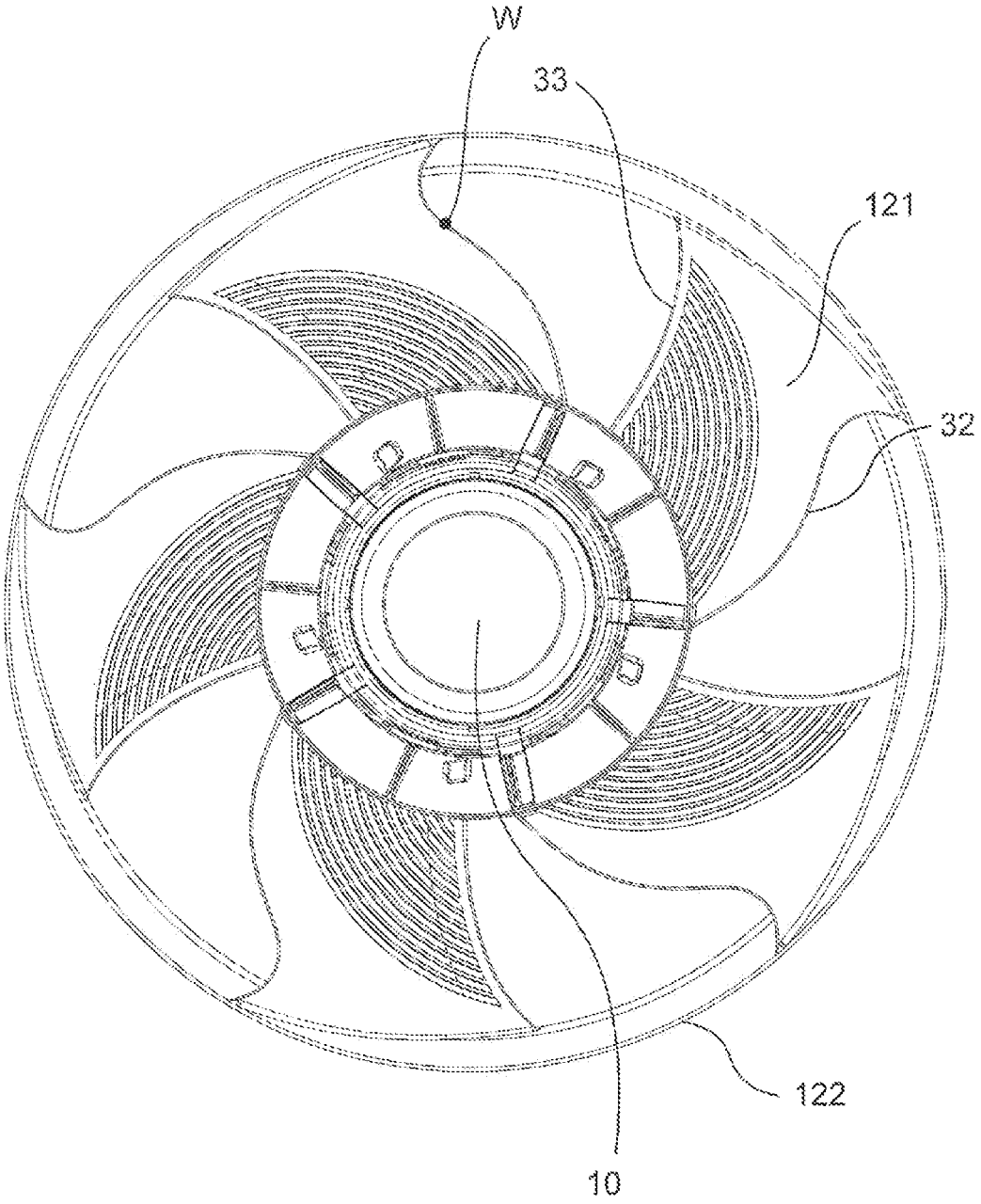
FIG. 4 is an axial rear view of the diagonal fan of FIG. 1.
Figure 5:
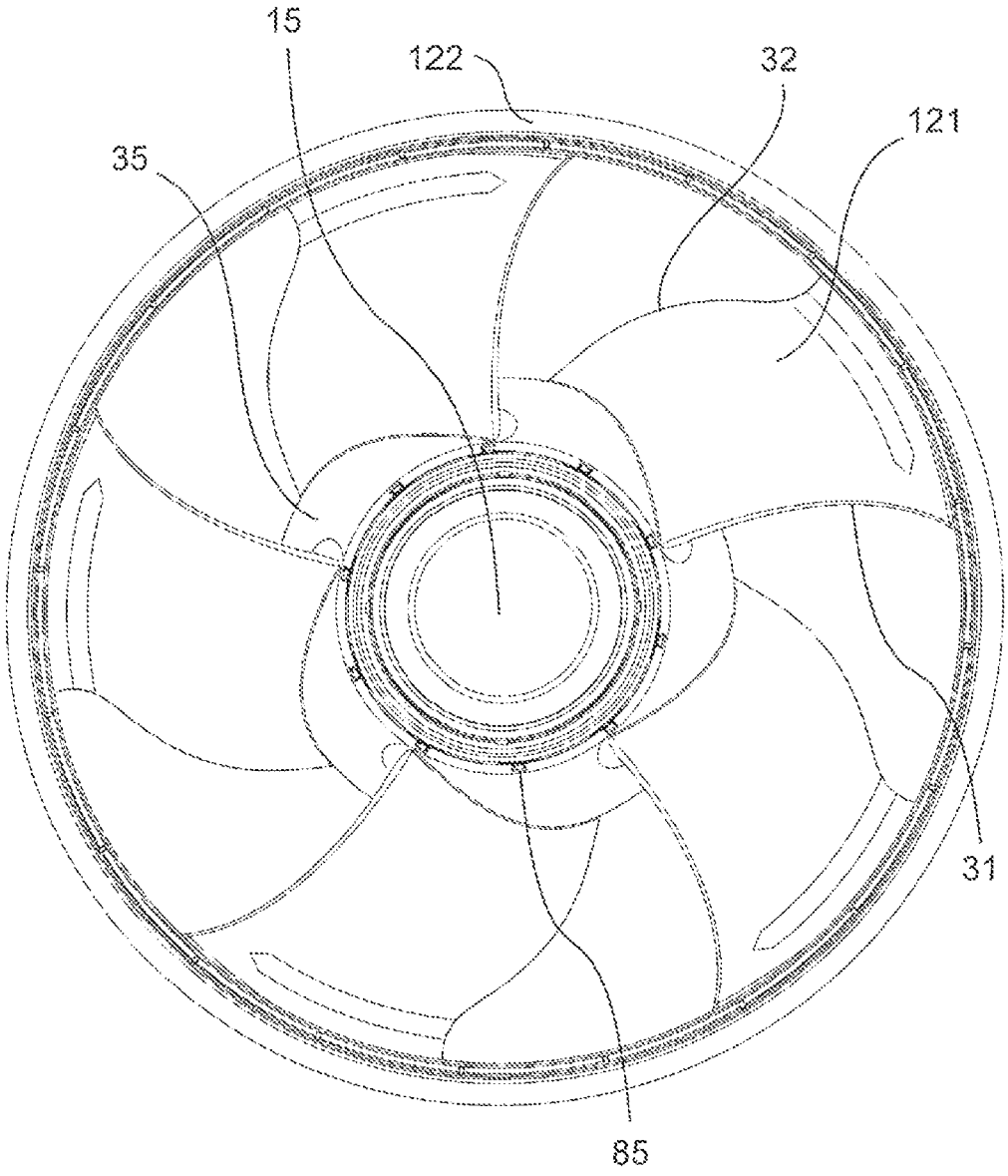
FIG. 5 is an axial top view of the diagonal fan of FIG. 1.

Referring now to FIGS. 1, 3, and 4, it is visible that the radial outer edge section 123 of the respective impeller vanes 121 is specifically designed in the region of 75-100% of the radial extension S. In this outer edge section 123, the stagger angle of the impeller vanes 121 is reduced over their respective axial extension by on average about 10° relative to the region that is farther radially internal. The front vane edges 33 have a continuous curved shape without a change in direction. The rear vane edges 32, however, are S-shaped, and the turning point W between the two opposed curved shapes is at 75% of the radial extension S, as shown in FIG. 4.

FIG. 3 shows the maximum impeller diameter Da and the intake diameter Ds at the air inlet 30, the Ds/Da ratio in the exemplary embodiment shown being 0.91. It can optionally be set in the range from 0.9 to 0.94. Furthermore, the mean axial vane extension La is determined relative to the maximum impeller diameter Da such that La/Da=0.15. This ratio can optionally be set in the range from 0.09 to 0.18.

Even though not shown in the figures, the diagonal fan 1 may also comprise an outlet guide vane device disposed downstream of the diagonal impeller 12 in the axial flow direction, which outlet guide vane device evens out the air flow generated by the diagonal impeller 12.

The invention claimed is:

1. A diagonal fan comprising an electric motor and a diagonal impeller configured to be driven about an axis of rotation (RA) by the electric motor, wherein the diagonal impeller defines an air inlet and an air outlet and has a hub and impeller vanes which are distributed in a circumferential direction, extending radially outwards from the hub, and wherein the impeller vanes are surrounded radially externally by a slinger ring, wherein a flow angle $\alpha D$ formed by the slinger ring relative to the axis of rotation (RA) increases from the air inlet to the air outlet, and a flow angle $\alpha N$ formed by the hub relative to the axis of rotation (RA) decreases from the air inlet to the air outlet.

2. The diagonal fan according to claim 1, wherein the flow angle $\alpha D1$ formed at the air inlet by the slinger ring relative to the axis of rotation (RA) is defined in an angular range from $0° \leq \alpha D1 \leq 12°$ and the flow angle $\alpha D2$ formed at the air outlet by the slinger ring relative to the axis of rotation (RA) is defined in an angular range from $10° \leq \alpha D2 \leq 30°$.

3. The diagonal fan according to claim 2, wherein a difference of the flow angles is defined in a range of values such that $2° \leq \alpha D2 - \alpha D1 \leq 20°$.

4. The diagonal fan according to claim 1, wherein the flow angle $\alpha N1$ formed at the air inlet by the hub relative to the axis of rotation (RA) from the air inlet to the air outlet is defined in an angular range from $20° \leq \alpha N1 \leq 55°$ and the flow angle $\alpha N2$ formed at the air outlet by the hub relative to the axis of rotation (RA) is defined in an angular range from $0° \leq \alpha N2 \leq 15°$.

5. The diagonal fan according to claim 1, wherein the flow angles $\alpha D$ and $\alpha N$ change in the continuous course of the slinger ring and the hub.

6. The diagonal fan according to claim 1, wherein the stagger angle of the impeller vanes decreases over their respective axial extension in a radial outer section of the respective impeller vane adjacent to the slinger ring by an angular range of 5° to 15°.

7. The diagonal fan according to claim 6, wherein the radial outer section is in a range from 75% to 100% of the radial extension (S) of the respective impeller vane, wherein 0% of the radial extension (S) is defined at the hub and 100% of the radial extension is defined at the slinger ring.

8. The diagonal fan according to claim 7, wherein the impeller vanes comprise a front vane edge facing the air inlet and a rear vane edge facing the air outlet, and wherein at least the rear vane edge has an S-shaped contour in an axial top view.

9. The diagonal fan according to claim 1, wherein a turning point (W) of curves in the S-shaped contour is in a range from 50% to 90% of the radial extension (S) of a respective impeller vane, wherein 0% of the radial extension (S) is defined at the hub and 100% of the radial extension is defined at the slinger ring.

10. The diagonal fan according to claim 8, wherein the front vane edges of the impeller vanes facing the air inlet are curved.

11. The diagonal fan according to claim 8, wherein a turning point (W) of curves in the S-shaped contour is in a range from 70% to 90% of the radial extension (S) of the respective impeller vane, wherein 0% of the radial extension (S) is defined at the hub and 100% of the radial extension is defined at the slinger ring.

12. The diagonal fan according to claim 1, wherein the diagonal impeller has a maximum impeller diameter Da and an intake diameter Ds at the air inlet, wherein a ratio of the intake diameter Ds to the impeller diameter Da is defined, such that $0.8 \leq Ds/Da \leq 0.95$.

13. The diagonal fan according to claim 1, wherein the impeller vanes have a mean axial vane extension La, which is proportional to a maximum impeller diameter Da of the diagonal impeller, such that $0.05 \leq La/Da \leq 0.25$.

14. The diagonal fan according to claim 1, wherein the hub has an axially central recess through which the electric motor extends in the axial direction, thus forming an inflow surface facing the air inlet.

15. The diagonal fan according to claim 1, wherein the hub forms a motor receptacle and multiple openings are provided at the motor receptacle on a side facing the air outlet, which provides an axial flow connection from the side of the air outlet to the side of the air inlet.

16. The diagonal fan according to claim 1, wherein an outlet guide vane device which homogenizes the air flow generated by the diagonal impeller is disposed downstream of the diagonal impeller viewed in the axial flow direction.

17. The diagonal fan according to claim 1, wherein the flow angle $\alpha D2$ formed at the air outlet by the slinger ring relative to the axis of rotation (RA) is defined in an angular range from $15° \leq \alpha D2 \leq 20°$.

18. The diagonal fan according to claim 1, wherein the diagonal impeller has a maximum impeller diameter Da and an intake diameter Ds at the air inlet, wherein a ratio of the intake diameter Ds to the impeller diameter Da is defined, such that $0.9 \leq Ds/Da \leq 0.94$.

19. The diagonal fan according to claim 1, wherein the impeller vanes have a mean axial vane extension La, which is proportional to a maximum impeller diameter Da of the diagonal impeller, such that $0.09 \leq La/Da \leq 0.18$.

* * * * *